US007806264B1

(12) United States Patent
Lai

(10) Patent No.: US 7,806,264 B1
(45) Date of Patent: Oct. 5, 2010

(54) TOOLBOX HAVING POSITIONING STRUCTURE

(76) Inventor: Jin-Tsai Lai, 12F-4, No. 666, Sec. 2, Wuquan W. Rd., Nantun District, Taichung City (TW) 40878

( * ) Notice: Subject to any disclaimer, the term of this patent is extended or adjusted under 35 U.S.C. 154(b) by 0 days.

(21) Appl. No.: 12/433,865

(22) Filed: Apr. 30, 2009

(51) Int. Cl.
*B65D 85/00* (2006.01)

(52) U.S. Cl. ..... 206/375; 206/372; 206/377

(58) Field of Classification Search ..... 206/234, 206/372, 373, 375, 378, 379, 377, 493, 349, 206/443; 211/70.6, 69; 408/239 R
See application file for complete search history.

(56) References Cited

U.S. PATENT DOCUMENTS 5,368,164 A * 11/1994 Bennett et al. ..... 206/373
5,826,719 A * 10/1998 Chen ..... 206/373
6,105,767 A * 8/2000 Vasudeva ..... 206/372
6,119,859 A * 9/2000 Wen ..... 206/379
6,213,296 B1 * 4/2001 Streich et al. ..... 206/373
6,755,302 B1 * 6/2004 Streich et al. ..... 206/373
6,896,136 B2 * 5/2005 Hu ..... 206/378
7,032,750 B2 * 4/2006 Amtenbrink ..... 206/379
7,328,796 B2 * 2/2008 Brunson et al. ..... 206/373
2002/0074254 A1 * 6/2002 Huang ..... 206/373
2008/0210593 A1 * 9/2008 Cornwell et al. ..... 206/747

* cited by examiner

*Primary Examiner*—David T Fidei

(57) ABSTRACT

A toolbox having a positioning structure includes a box body and a positioning seat mounted in the box body. The positioning seat has multiple first grooves and multiple second grooves respectively defined therein. The multiple first grooves are respectively vertically crossed the multiple second grooves to form multiple blocks. Each block is located between two adjacent first grooves and two adjacent second grooves. Multiple clipping strips are respectively received in the multiple first grooves. Each clipping strip has multiple clip portions formed thereon. The multiple clip portions of each clipping strip are respectively located in multiple intersections of the first groove and the second groove. Each clip portion includes at least one elastic sheet.

14 Claims, 6 Drawing Sheets

TOOLBOX HAVING POSITIONING STRUCTURE

BACKGROUND OF THE INVENTION

1. Field of the Invention

The present invention relates to a toolbox, and more particularly to a toolbox having a positioning structure.

2. Description of Related Art

A conventional toolbox includes two shells connected to each other. Each shell has two series of tenons formed thereon. The two series of tenons are parallel to each other. A space is defined between the two series of tenons for receiving tool bits. Each of the tenon has a low elastic structure for positioning the tool bits. Two sides of each tool bit are respectively clamped by two corresponding tenons such that the tool bits lie on the shell.

However, it is inconvenient to take the tool bits from the tool box in a lay position. Furthermore, the tenons are integrally formed on the shell and are not detachable. When the tenons are bent or broken due to a long time operation, the tenons can not be detached for replacement.

The present invention has arisen to mitigate and/or obviate the disadvantages of the conventional toolbox.

SUMMARY OF THE INVENTION

The main objective of the present invention is to provide an improved toolbox having a positioning structure.

To achieve the objective, a toolbox having a positioning structure in accordance with the present invention comprises a box body and a positioning seat mounted in the box body. The positioning seat has multiple first grooves and multiple second grooves respectively defined therein. The multiple first grooves are respectively vertically crossed the multiple second grooves to form multiple blocks. Each block is located between two adjacent first grooves and two adjacent second grooves. Each second groove has a curved inner periphery formed on a distal end thereof. Multiple clipping strips are respectively received in the multiple first grooves. Each clipping strip has multiple clip portions formed thereon for adapting to position multiple tool bits. The multiple clip portions of each clipping strip are respectively located in multiple intersections of the first groove and the second groove. Each clip portion includes at least one elastic sheet for adapting to cooperatively clamp the tool bit. Each second groove is separated into multiple spaces by the multiple clipping strips respectively mounted in the multiple first grooves. Each space is enclosed by two adjacent elastic sheets of two adjacent clipping strips and two adjacent blocks for adapting to receive a tool bit. An extra space is enclosed by the elastic sheet mounted in the first groove and the curved inner periphery of the second groove for adapting to receive the tool bit. The two adjacent elastic sheets are provided for clamping two sides of the tool bit to prevent the tool bit from detaching.

Further benefits and advantages of the present invention will become apparent after a careful reading of the detailed description with appropriate reference to the accompanying drawings.

DETAILED DESCRIPTION OF THE INVENTION

Figure 1:
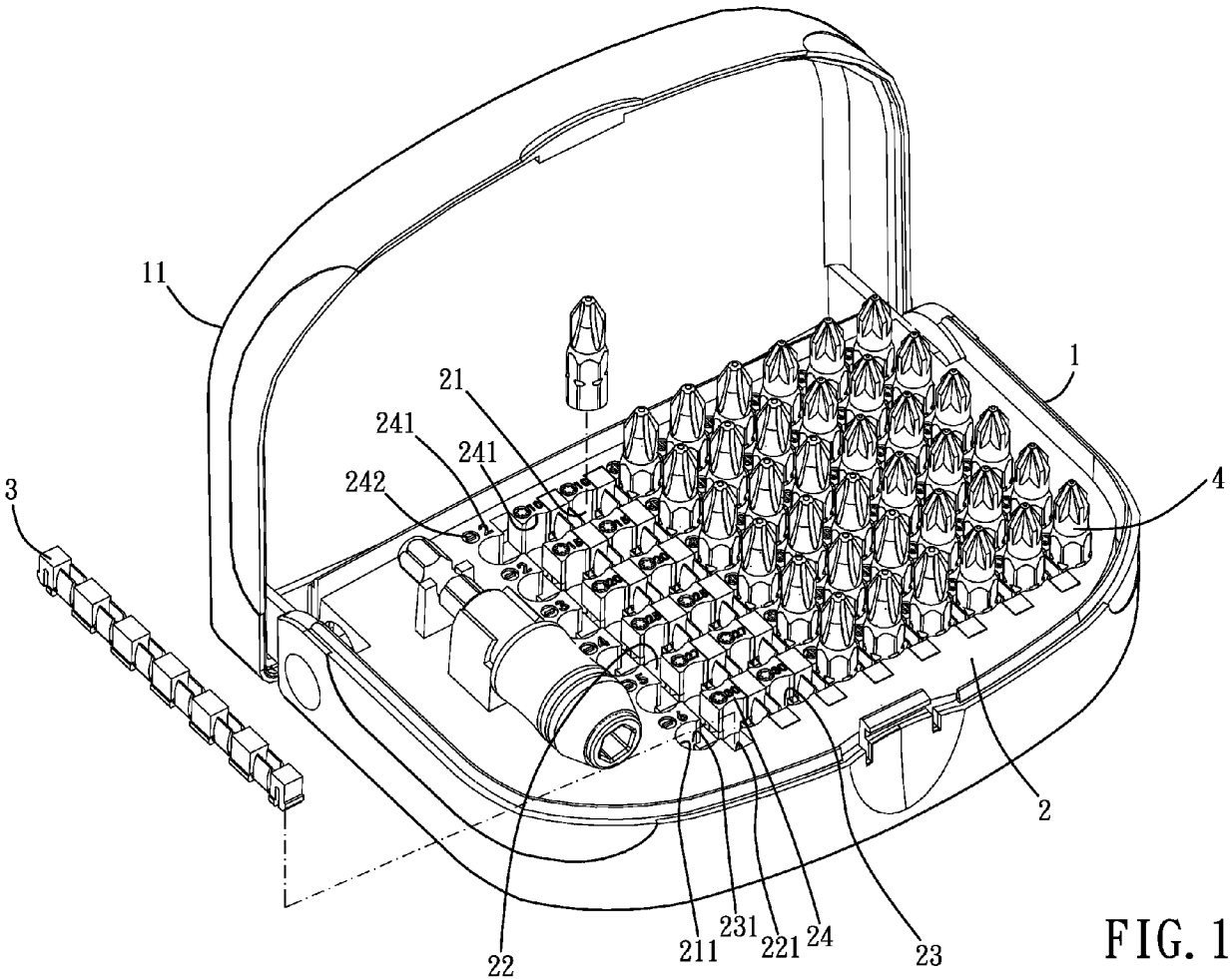
FIG. 1 is a partial exploded perspective view of a toolbox having a positioning structure in accordance with the present invention.
Figure 2:
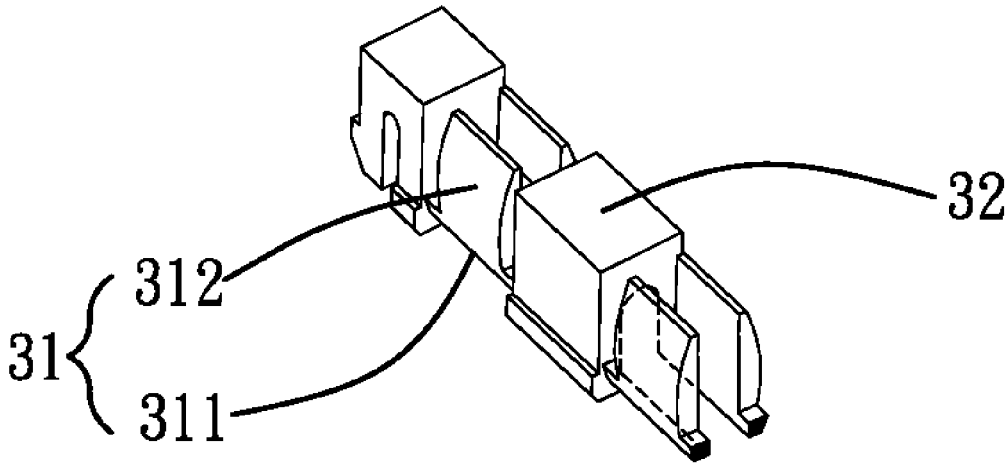
FIG. 2 is an enlarged partial perspective view of a clipping strip of the toolbox having a positioning structure in accordance with the present invention.
Figure 3:
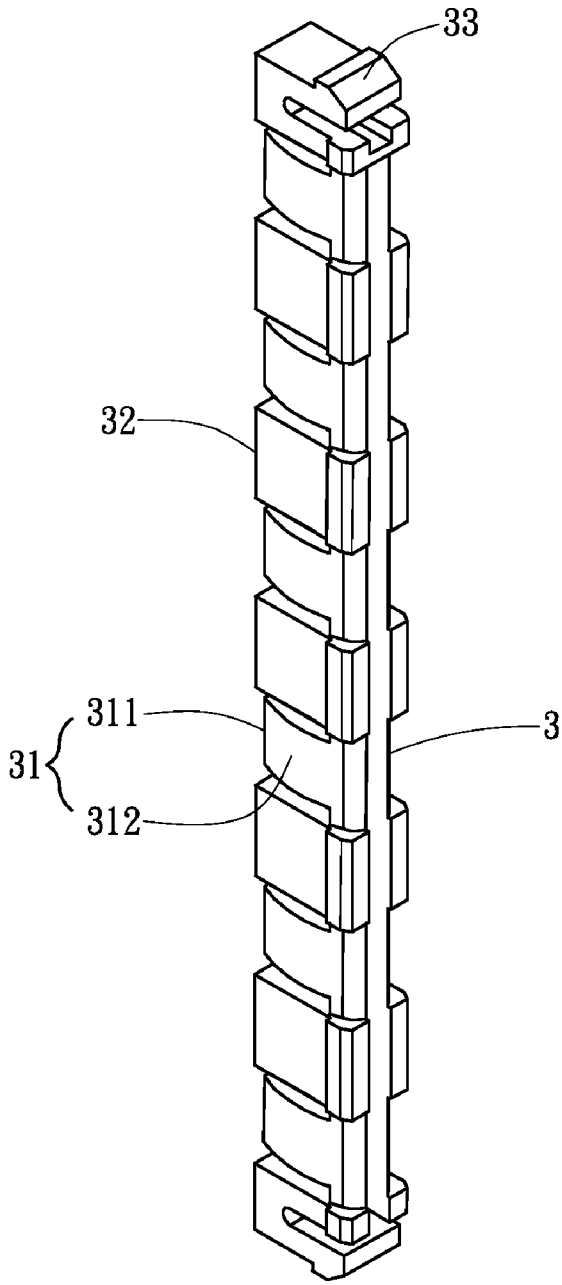
FIG. 3 is an enlarged perspective view of the clipping strip in another direction.
Figure 4:
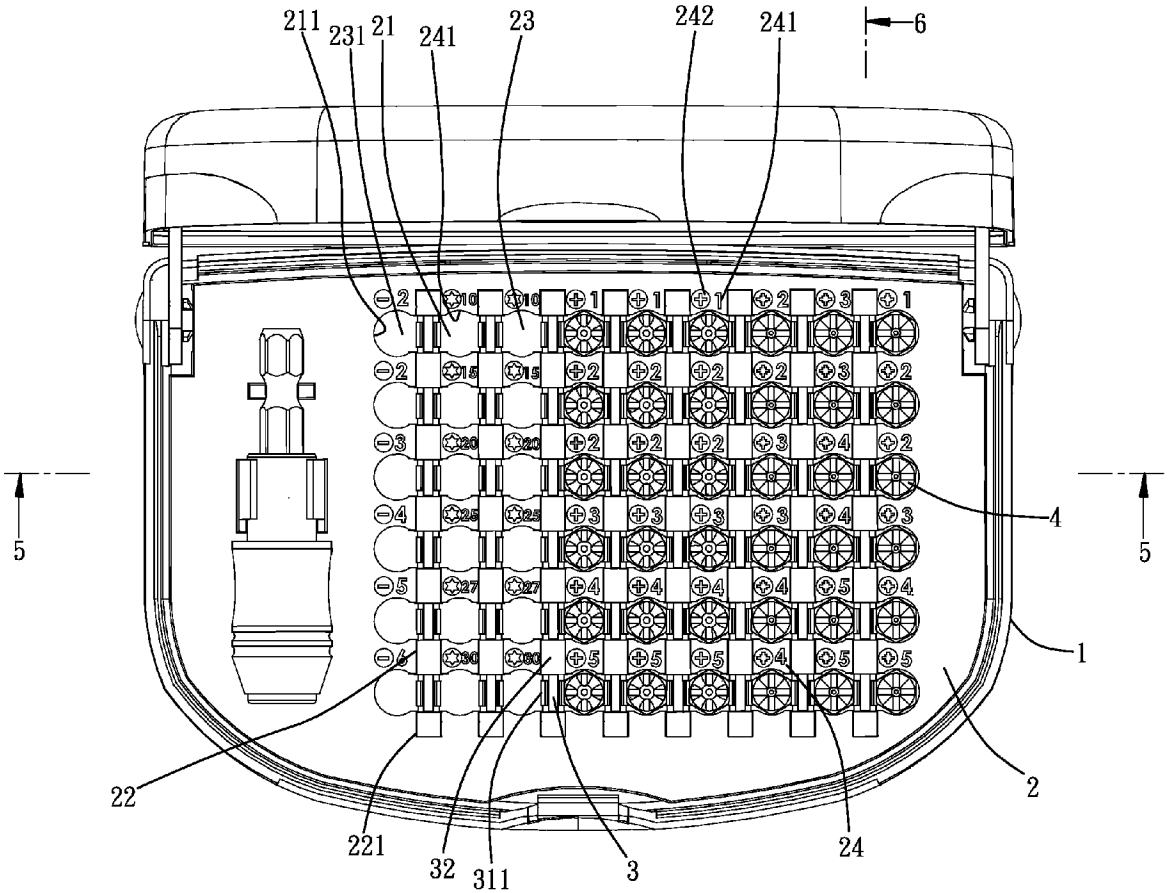
FIG. 4 is a top plan view of the toolbox having a positioning structure in accordance with the present invention.
Figure 5:
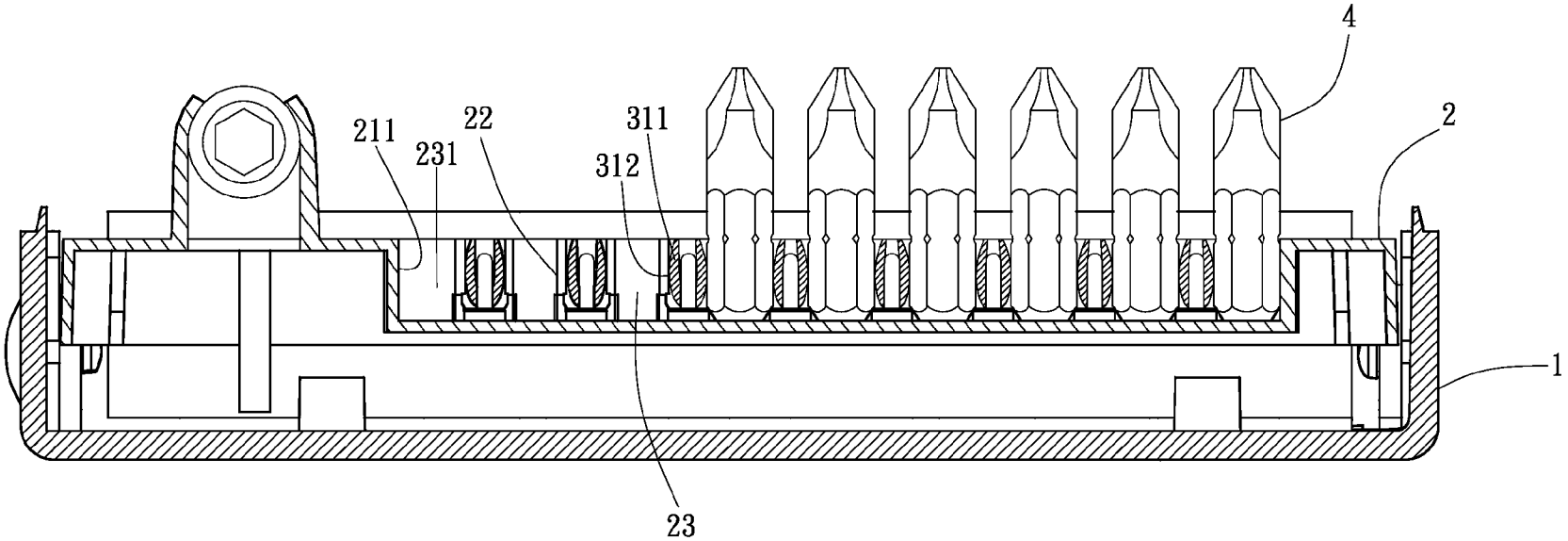
FIG. 5 is a cross-sectional view of the toolbox having a positioning structure in accordance with the present invention taken along line 5-5 in FIG. 4.
Figure 6:
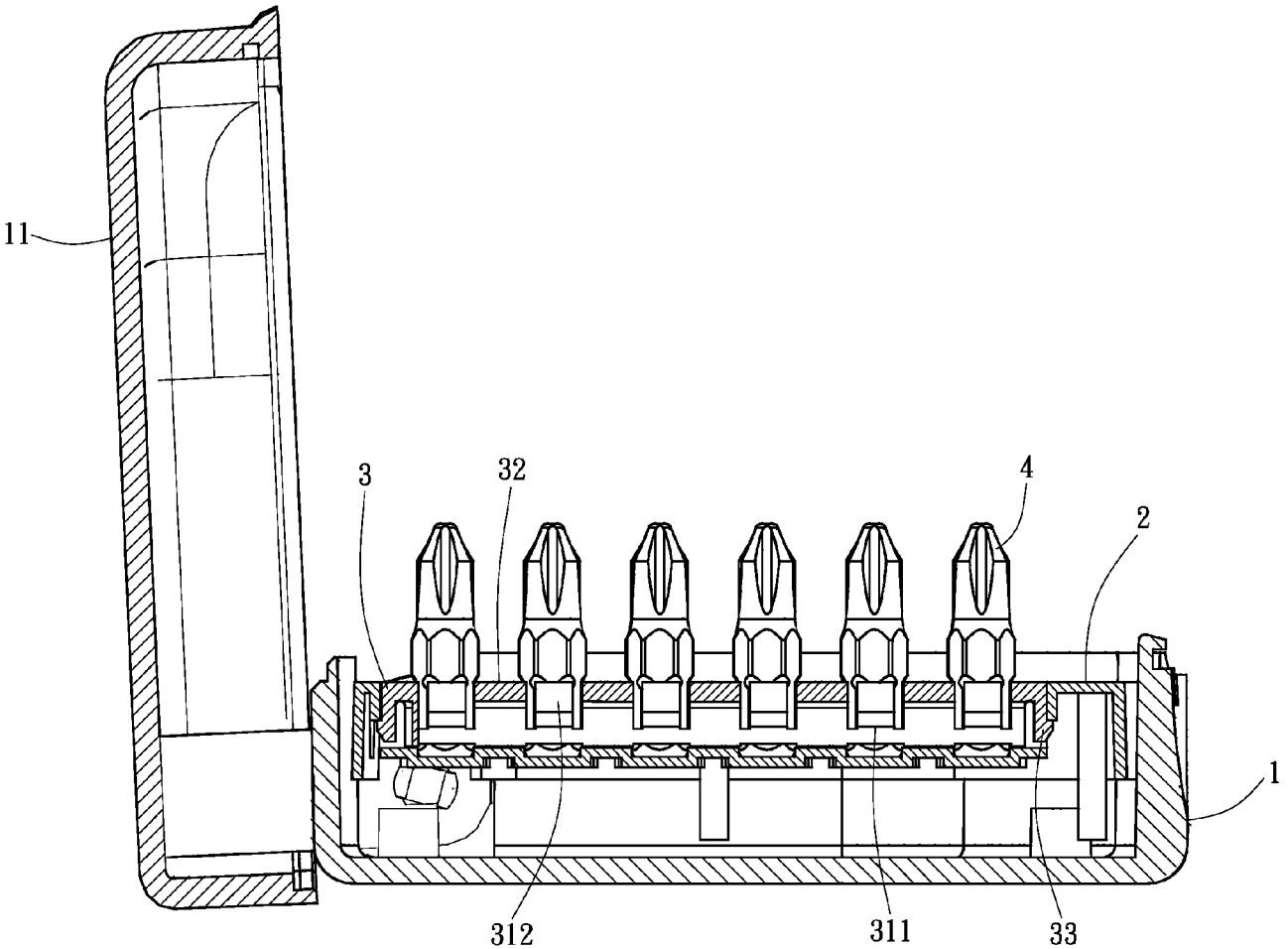
FIG. 6 is a cross-sectional view of the toolbox having a positioning structure in accordance with the present invention taken along line 6-6 in FIG. 4.

Referring to the drawings and initially to FIGS. 1-6, a toolbox having a positioning structure in accordance with the present invention comprises a box body 1 and a positioning seat 2 mounted in the box body 1.

The positioning seat 2 has multiple first grooves 22 defined therein. In the preferred embodiment of the present invention, the multiple first grooves 22 are equidistantly defined in the positioning seat 2. Each first groove 22 has two mortises 221 respectively defined in two distal ends thereof. Each first groove 22 is parallel to another first groove 22. The positioning seat 2 has multiple second grooves 21 vertically defined therein relative to the multiple first grooves 22. In the preferred embodiment of the present invention, the multiple second grooves 21 are horizontally defined in the positioning seat 2 relative to the multiple first grooves 22. Each second groove 21 has two curved inner peripheries 211 formed on two distal ends thereof. Each second groove 21 is parallel to another second groove 21. The multiple first grooves 22 are respectively, equidistantly, and vertically crossed the multiple second grooves 21 to form multiple blocks 24. Each block 24 is located between two adjacent first grooves 22 and two adjacent second grooves 21. Each block 24 has a pattern 242 and a numeral 241 formed on a top thereof. The pattern 242 is provided for adapting to reveal a type of a tool bit 4. The numeral 241 is provided for adapting to reveal a size of the tool bit 4.

Multiple clipping strips 3 are respectively received in the multiple first grooves 22. Each clipping strip 3 is formed by plastic injection molding. Each clipping strip 3 has two tenons 33 respectively formed on two distal ends thereof for corresponding to the two mortises 221 in each first groove 22. The two tenons 33 of each clipping strip 3 are respectively received in the two mortises 221 in a corresponding first groove 22 such that the clipping strip 3 is fixed in the corresponding first groove 22 to prevent the clipping strip 3 from detaching from the positioning seat 2. Each clipping strip 3 has multiple clip portions 31 and multiple locating blocks 32 formed thereon. The multiple clip portions 31 and the multiple locating blocks 32 are alternately arranged such that each clip portion 31 is disposed between two adjacent locating blocks 32. Each locating block 32 in each clipping strip 3 is positioned between two adjacent blocks 24 such that each clip portion 31 in the same clipping strip 3 is positioned in an intersection of the corresponding first groove 22 and the corresponding second groove 21. Each clip portion 31 includes two elastic sheets 311. Each elastic sheet 311 of each clip portion 31 has an arc surface 312 outwardly formed thereon for abutting against the tool bit 4.

Each second groove 21 has multiple curved surfaces 241 formed on two laterals thereof. Each curved surface 241 is positioned on a lateral side of an adjacent block 24. Each second groove 21 is separated into multiple spaces 23 by the multiple clipping strips 3 respectively mounted in the multiple first grooves 22. Each space 23 is enclosed by two adjacent elastic sheets 311 of two adjacent clipping strips 3 and two curved surface 241 of two adjacent blocks 24. Multiple extra spaces 231 are enclosed by the curved inner peripheries 211 in the multiple second grooves 21 and the multiple adjacent elastic sheets 311 of the adjacent clipping strip 3.

Multiple tool bits 4 are respectively plugged into the multiple spaces 23 and the multiple extra spaces 231. The tool bit 4 received in the corresponding space 23 has two lateral sides elastically clamped by the two adjacent elastic sheets 311 and the other parts confined by the two curved surfaces 241 of the two adjacent blocks 24. The tool bit 4 received in the corresponding extra space 231 has one side elastically clamped by the adjacent elastic sheet 311 and the other part confined by the curved inner periphery 211 of the corresponding second groove 21.

The benefits of the toolbox having a positioning structure in accordance with the present invention are described in the following: The tool bit 4 is clamped by the arc surface 312 of the elastic sheet 311 such that a clamping force is concentrated on a middle of the tool bit 4 for stably holding the tool bit 4. Two adjacent clipping strips 3 are provided for clamping a row of tool bits 4 such that the clamping forces from the two adjacent clipping strips 3 are equal to prevent the tool bit 4 from inclining. The arc surface 312 of the elastic sheet 311 is provided for elastically sliding the tool bit 4 into the space 23/extra space 231 such that the tool bit 4 can be easily plugged into the tool box and easily detached from the tool box.

Although the invention has been explained in relation to its preferred embodiment, it is to be understood that many other possible modifications and variations can be made without departing from the spirit and scope of the invention as hereinafter claimed.

What is claimed is:

1. A toolbox having a positioning structure comprising:

a box body;

a positioning seat mounted in the box body, the positioning seat having multiple first grooves and multiple second grooves respectively defined therein, the multiple first grooves respectively vertically crossed the multiple second grooves to form multiple blocks, each block located between two adjacent first grooves and two adjacent second grooves; and multiple clipping strips respectively received in the multiple first grooves, each clipping strip having multiple clip portions formed thereon for adapting to position multiple tool bits, the multiple clip portions of each clipping strip respectively located in multiple intersections of a corresponding first groove and a corresponding second groove, each clip portion including at least one elastic sheet for adapting to cooperatively clamp the tool bit;

wherein each second groove is separated into multiple spaces by the multiple clipping strips respectively mounted in the multiple first grooves; each space is enclosed by two adjacent elastic sheets of two adjacent clipping strips and two adjacent blocks for adapting to receive a tool bit; the two adjacent elastic sheets are provided for clamping two sides of the tool bit to prevent the tool bit from detaching.

2. The toolbox having a positioning structure as claimed in claim 1, wherein each clipping strip has multiple locating blocks formed thereon and alternately arranged, each locating block positioned between two adjacent blocks such that the clip portion positioned in the intersection of the first groove and the second groove.

3. The toolbox having a positioning structure as claimed in claim 1, wherein each of the at least one elastic sheet has an arc surface outwardly formed thereon for adapting to abut against the tool bit.

4. The toolbox having a positioning structure as claimed in claim 1, wherein each clipping strip has at least one tenon formed one end thereof and each first groove has at least one mortise defined in one end thereof for correspondingly fixing the clipping strip in the first groove.

5. The toolbox having a positioning structure as claimed in claim 1, wherein each block has a pattern formed on a top thereof for showing a type of the tool bit.

6. The toolbox having a positioning structure as claimed in claim 1, wherein each block has a numeral formed on a top thereof for showing a size of the tool bit.

7. The toolbox having a positioning structure as claimed in claim 1, wherein each clipping strip is formed by plastic injection molding.

8. A toolbox having a positioning structure comprising:

a box body;

a positioning seat mounted in the box body, the positioning seat having multiple first grooves and multiple second grooves respectively defined therein, the multiple first grooves respectively vertically crossed the multiple second grooves to form multiple blocks, each block located between two adjacent first grooves and two adjacent second grooves, each second groove having a curved inner periphery formed on a distal end thereof; and multiple clipping strips respectively received in the multiple first grooves, each clipping strip having multiple clip portions formed thereon for adapting to position multiple tool bits, the multiple clip portions of each clipping strip respectively located in multiple intersections of the first groove and the second groove, each clip portion including at least one elastic sheet for adapting to cooperatively clamp the tool bit;

wherein each second groove is separated into multiple spaces by the multiple clipping strips respectively mounted in the multiple first grooves; each space is enclosed by two adjacent elastic sheets of two adjacent clipping strips and two adjacent blocks for adapting to receive a tool bit; an extra space is enclosed by the elastic sheet mounted in the first groove and the curved inner periphery of the second groove for adapting to receive the tool bit; the two adjacent elastic sheets are provided for clamping two sides of the tool bit to prevent the tool bit from detaching.

9. The toolbox having a positioning structure as claimed in claim 8, wherein each clipping strip has multiple locating blocks formed thereon and alternately arranged, each locating block positioned between two adjacent blocks such that the clip portion positioned in the intersection of the first groove and the second groove.

10. The toolbox having a positioning structure as claimed in claim 8, wherein each of the at least one elastic sheet has an arc surface outwardly formed thereon for adapting to abut against the tool bit.

11. The toolbox having a positioning structure as claimed in claim 8, wherein each clipping strip has at least one tenon formed one end thereof and each first groove has at least one mortise defined in one end thereof for correspondingly fixing the clipping strip in the first groove.

12. The toolbox having a positioning structure as claimed in claim 8, wherein each block has a pattern formed on a top thereof for showing a type of the tool bit.

13. The toolbox having a positioning structure as claimed in claim 8, wherein each block has a numeral formed on a top thereof for showing a size of the tool bit.

14. The toolbox having a positioning structure as claimed in claim 8, wherein each clipping strip is formed by plastic injection molding.

* * * * *